US010914023B2

(12) United States Patent
Alexander et al.

(10) Patent No.: US 10,914,023 B2
(45) Date of Patent: Feb. 9, 2021

(54) ATTACHABLE FABRIC ASSEMBLY

(71) Applicant: GM Global Technology Operations LLC, Detroit, MI (US)

(72) Inventors: Paul W. Alexander, Ypsilanti, MI (US); Nancy L. Johnson, Northville, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 515 days.

(21) Appl. No.: 15/862,130

(22) Filed: Jan. 4, 2018

(65) Prior Publication Data

US 2019/0203392 A1 Jul. 4, 2019

(51) Int. Cl.

| | |
|---|---|
| ***D04B 21/04*** | (2006.01) |
| ***D04B 1/02*** | (2006.01) |
| ***A44B 18/00*** | (2006.01) |
| ***D04B 21/02*** | (2006.01) |
| ***D04B 21/20*** | (2006.01) |

(52) U.S. Cl.

CPC ..... *D04B 21/04* (2013.01); *A44B 18/0034* (2013.01); *D04B 1/02* (2013.01); *D04B 21/02* (2013.01); *D04B 21/20* (2013.01); *A44B 18/0038* (2013.01); *D10B 2401/16* (2013.01); *D10B 2501/0632* (2013.01)

(58) Field of Classification Search

CPC . D04B 1/22; D04B 1/02; D04B 21/02; D04B 21/20; D04B 21/202; A44B 18/0034

See application file for complete search history.

(56) References Cited

U.S. PATENT DOCUMENTS 7,428,772 B2 * 9/2008 Rock ..... A41D 13/002 28/159

* cited by examiner

*Primary Examiner* — Jenna L Johnson

(74) *Attorney, Agent, or Firm* — Cantor Colburn LLP

(57) ABSTRACT

A fabric assembly includes a knitted fabric and a filament. The knitted fabric is adapted to move between a stretched state extended along a direction of an applied force, and a relaxed state. The filament is disposed in the knitted fabric, and includes a plurality of loops longitudinally spaced apart from one-another. Each loop of the plurality of loops are adapted to project outward from the knitted fabric when in the stretched state, and substantially retract into the knitted fabric when in the relaxed state.

20 Claims, 4 Drawing Sheets

ATTACHABLE FABRIC ASSEMBLY

INTRODUCTION

The subject disclosure relates to fabrics, and more particularly, to an attachable fabric assembly.

Fabrics are known to cover a wide variety of components. Such components may include interior support structure and/or framework of furniture, planar surfaces such as walls, interior of vehicles including vehicle seats, other fabrics, and a wide variety of other components. To achieve a desired appearance and/or durability, such fabrics are often attached to the components. Depending upon the component, the attachment means may vary. Such attachment means may be expensive, complicated or awkward to achieve, and time consuming to accomplish.

Accordingly, it is desirable to develop improvements in fabric attachment techniques for a wide range of applications.

SUMMARY

A fabric assembly according to one, non-limiting, embodiment includes a knitted fabric and a filament. The knitted fabric is adapted to move between a stretched state extended along a direction of an applied force, and a relaxed state. The filament is disposed in the knitted fabric, and includes a plurality of loops longitudinally spaced apart from one-another. Each loop of the plurality of loops are adapted to project outward from the knitted fabric when in the stretched state, and substantially retract into the knitted fabric when in the relaxed state.

Additionally to the foregoing embodiment, the fabric assembly includes a component including a plurality of hooks projecting outward from the component for engaging the plurality of loops when in the stretched state and thus cinching the component to the knitted fabric when in the relaxed state.

In the alternative or additionally thereto, in the foregoing embodiment, the filament and the plurality of hooks are electrically conductive.

In the alternative or additionally thereto, in the foregoing embodiment, the cinching occurs along a direction that is substantially normal to the elongated filament and direction of the applied force.

In the alternative or additionally thereto, in the foregoing embodiment, the knitted fabric is more compliant than the filament.

In the alternative or additionally thereto, in the foregoing embodiment, the filament is one of a mono-filament and a braided cable.

In the alternative or additionally thereto, in the foregoing embodiment, the knitted fabric is a double knitted fabric.

In the alternative or additionally thereto, in the foregoing embodiment, at least one loop of the plurality of loops are looped about a knit yarn of the knitted fabric to fix a location of the at least one loop.

In the alternative or additionally thereto, in the foregoing embodiment, the fabric assembly includes a plurality of buttons, wherein each button of the plurality of button is attached to a respective loop of the plurality of loops.

In the alternative or additionally thereto, in the foregoing embodiment, the knitted fabric is fusible.

In the alternative or additionally thereto, in the foregoing embodiment, the filament is fusible.

A fabric assembly adapted to engage a component according to another, non-limiting, embodiment includes a knitted fabric, a filament having a plurality of attachment elements, and a plurality of mating elements. The knitted fabric has a stretched state along a first direction, and a relaxed state. The filament is woven into the knitted fabric. Each attachment element of the plurality of attachment elements are adapted to project outward from the knitted fabric when in one of the stretched state and the relaxed state, and retract into the knitted fabric when in the other of the stretched state and the relaxed state. The plurality of mating elements are attached to, and projecting outward from, the component. Each mating element of the plurality of mating elements is adapted to engage a respective one of the plurality of attachment elements when the plurality of attachment elements are projecting outward from the knitted fabric. Once attached, the plurality of attachments elements may be retracted into the knitted fabric, thereby cinching the knitted fabric to the component.

Additionally to the foregoing embodiment, the knitted fabric includes a surface, the plurality of attachment elements project outward from the surface, the filament extends along a second direction that is substantially normal to the first direction, and the plurality of attachment elements retract when the knitted fabric moves from the stretched state to the relaxed state.

In the alternative or additionally thereto, in the foregoing embodiment, the knitted fabric includes an edge, the filament extends along the edge, the plurality of attachment elements project outward from the edge when in the relaxed state and are retracted into the knitted fabric when in the stretched state.

In the alternative or additionally thereto, in the foregoing embodiment, the plurality of loops are generally coplanar to the knitted fabric.

In the alternative or additionally thereto, in the foregoing embodiment, the plurality of attachment elements include hooks.

In the alternative or additionally thereto, in the foregoing embodiment, the plurality of attachment elements include loops, and the plurality of mating elements include hooks.

In the alternative or additionally thereto, in the foregoing embodiment, the plurality of attachment elements include posts.

In the alternative or additionally thereto, in the foregoing embodiment, the plurality of attachment elements include buttons.

In the alternative or additionally thereto, in the foregoing embodiment, the plurality of attachment elements include clips.

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which.

DETAILED DESCRIPTION

Figure 1:
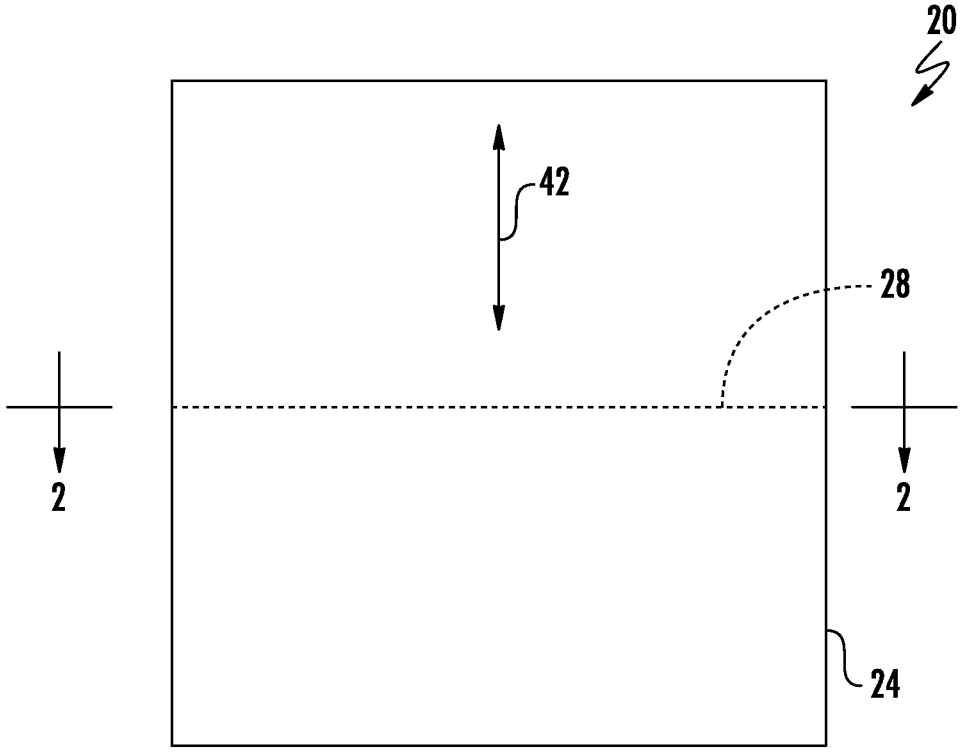
FIG. 1 is a plan view of a fabric assembly in a relaxed state as one exemplary embodiment.

The following description is merely exemplary in nature and is not intended to limit the present disclosure, its application or uses. It should be understood that throughout the drawings, corresponding reference numerals indicate like or corresponding parts and features.

Figure 2:
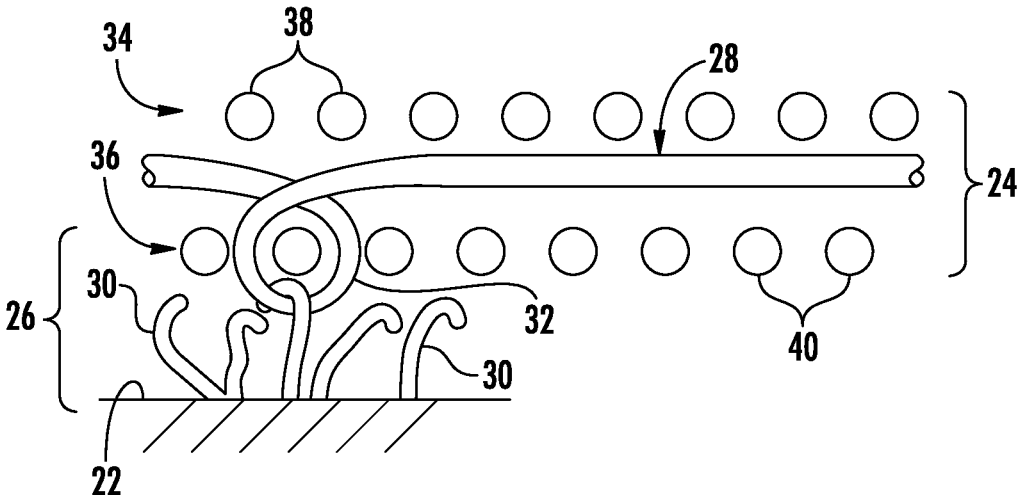
FIG. 2 is a cross section of the fabric assembly in the relaxed state and taken along line 2-2 of FIG. 1.

Referring to FIGS. 1 and 2, and in accordance with an exemplary embodiment, a fabric assembly 20 is adapted to efficiently and quickly attach to a component 22. Non-limiting examples of the component 22 may include furniture support structures, walls, drapery structures, vehicle structures such as seat structures and side panel structures, other fabrics, and many other components.

Figure 4:
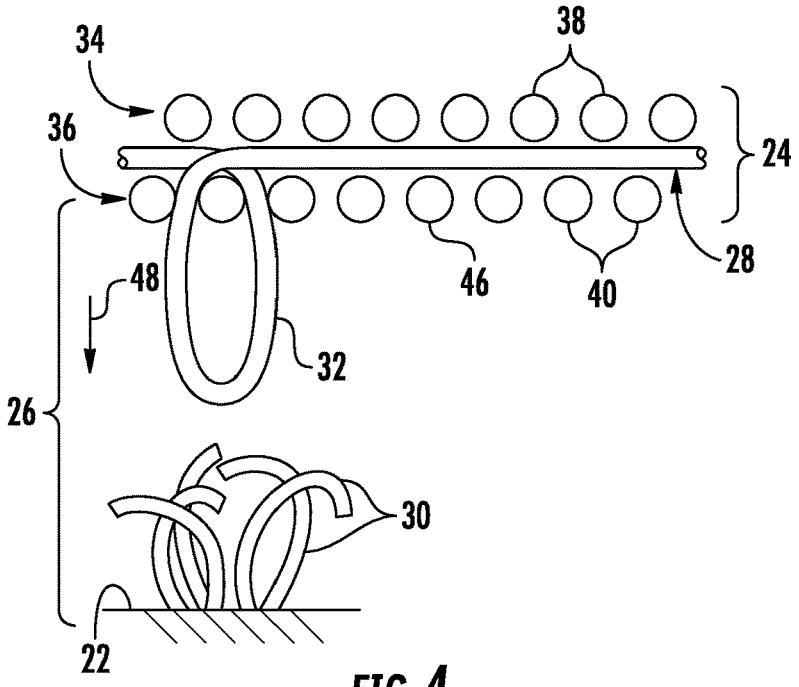
FIG. 4 is a cross section of the fabric assembly in the stretched state and taken along line 4-4 of FIG. 3.

The fabric assembly 20 may include a fabric 24, and an attachment arrangement 26 carried between the component 22 and the fabric 24. In FIG. 4, the attachment arrangement 26 is illustrated in a disengaged position, and in FIG. 2, the attachment arrangement 26 is illustrated in an engaged position. The attachment arrangement 26 may include a filament 28 that may be generally woven, or knitted, into the fabric 24, and a plurality of mating elements 30 fixed to the component 22. The filament 28 may include a plurality of attachment elements 32 (i.e., one illustrated in FIGS. 2 and 4) adapted to attach, or mate, with the mating elements 30. In one, non-limiting, embodiment, the attachment arrangement 26 may be a hook-and-loop arrangement, wherein the plurality of attachment elements 32 is a plurality of loops, and the plurality of mating elements 30 is a plurality of hooks. It is further contemplated and understood that the plurality of attachment elements may take the form of any shape capable of attachment including buttons, clips, and posts. In one example, the buttons or clips (not illustrated) may be attached to end portions of the attachment elements or loops 32.

In one embodiment, the fabric 24 may be a double woven, or knitted, fabric including first and second layers 34, 36 of respective woven, or knitted, yarns, or threads, 38, 40. The yarns 38 may each extend longitudinally in a side-by-side fashion. Similarly, the yarns 40 may each extend longitudinally in a side-by-side fashion, such that the yarns 38 are substantially parallel to the yarns 40.

The elongated filament 28 may extend longitudinally across, and may traverse the yarns 38, 40. In one embodiment, the filament may be disposed substantially normal to the yarns 38, 40. In at least the example of the attachment elements 32 being loops, at least one loop of the plurality of loops 32 may be looped about a respective yarn 40 of the second layer 36. By looping the filament 28 about selected yarns 40, the plurality of loops 32 may generally be fixed at a desired location with respect to the fabric 24. The filament 28 may be a mono-filament or braided cable, may be made of plastic, composite, or metal, and is less compliant (i.e., stretchable) than the fabric 24.

Figure 3:
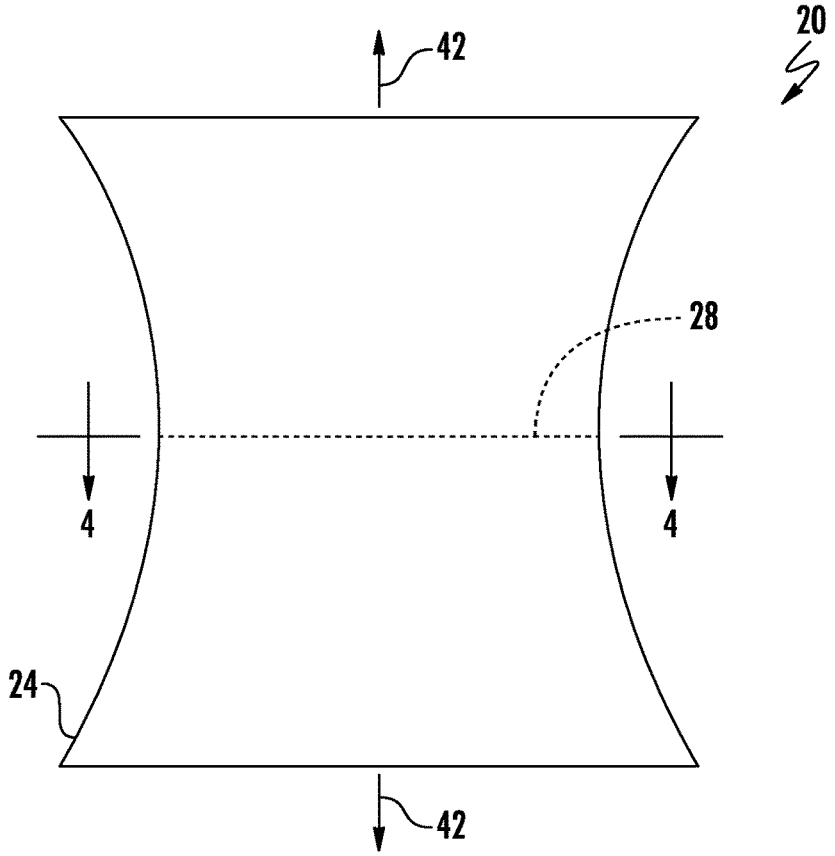
FIG. 3 is a plan view of the fabric assembly in a stretched state.

During attachment of the fabric 24 to the component 22, the knitted fabric 24 may be initially in a relaxed, or un-stretched, state, see FIG. 1. When in the relaxed state, the attachment elements, or loops, 32 of the filament 28 are, at least in-part, retracted into the knitted fabric 24. A force (see arrows 42) may then be applied to the knitted fabric 24, thereby stretching the fabric 24 in a direction of the force 42, see FIG. 3. By placing the fabric 24 in a stretched state, the loops 32 extend further outward from a surface 46 of the knitted fabric 24, which may be generally planar (see FIG. 4). In one embodiment, the loops 32 may project outward from the surface 46, and generally in a direction (see arrow 48 in FIG. 4) that may be substantially normal to the elongated filament 28 (i.e., generally a centerline of the filament), and the elongated yarns 38, 40.

With the knitted fabric 24 in the stretched state and the loops 32 extended (i.e., hyperextended), the fabric 24 may be placed, or pressed, against the component 22 causing the mating elements, or hooks, 30 to attach to the extended loops 32. Once attached, the force (see arrows 42), which generally co-extends with the yarns 38, 40, may be released causing the knitted fabric 24 to return to the relaxed state of FIG. 2. As the knitted fabric 24 returns to the relaxed state, the loops 32 retract into the fabric, thus pulling the hooks 30 and component 22 toward the knitted fabric 24. That is, the knitted fabric 24 and the component 22 are cinched together.

In one embodiment, the attachment and mating elements 32, 30 of the attachment arrangement 26 may be electrically conductive forming a circuit for any variety of applications (e.g., heating a seat). In another embodiment, the knitted fabric may be fusible. If fusible, and after cinching, the knitted fabric 24 may be steamed to promote fusion and thereby strengthen the fabric assembly 20 forming a coherent sheet that inhibits unraveling of the knitted yarns 38, 40. Similarly, the filament 28 may be made of a fusible material capable of being fused to the surrounding fabric 24.

Figure 5:
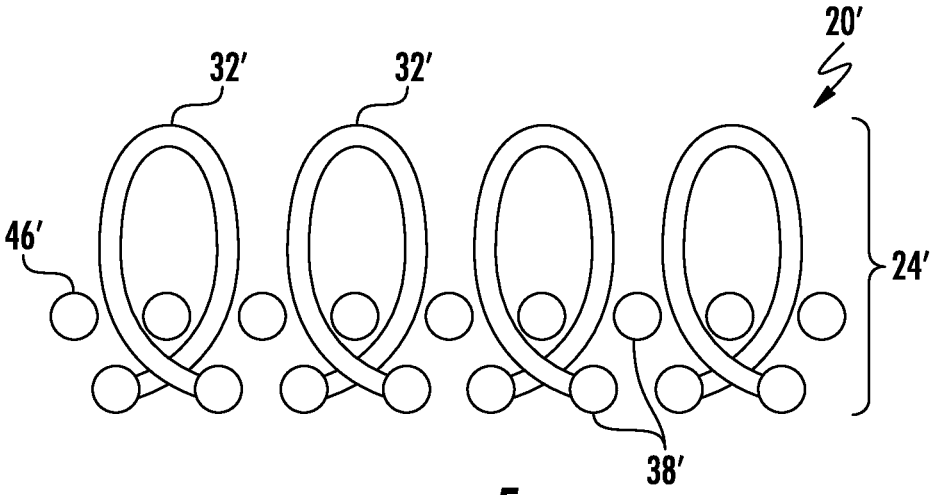
FIG. 5 is a cross section of a second embodiment of a fabric assembly prior to fusion.
Figure 6:
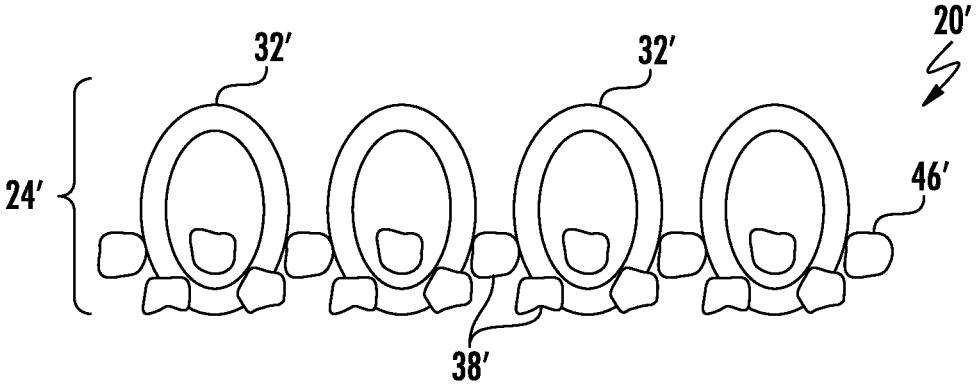
FIG. 6 is a cross section of the fabric assembly of FIG. 5 after fusion.
Figure 7:
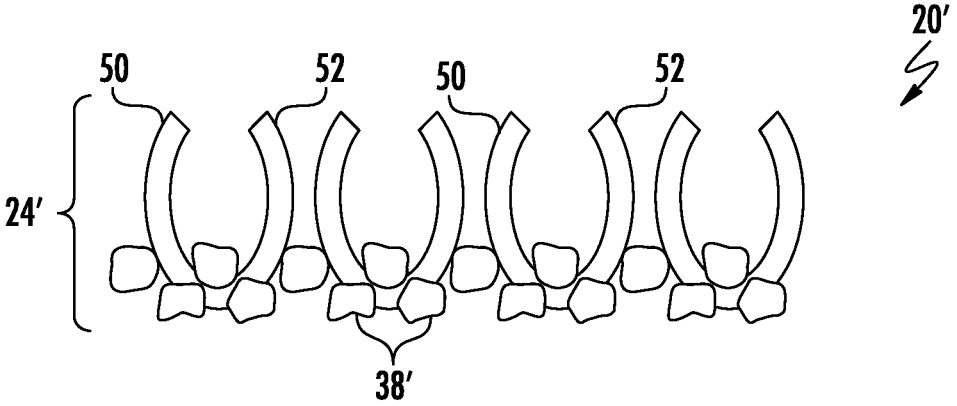
FIG. 7 is a cross section of the fabric assembly of FIG. 6 with a plurality of loops cut to form hooks.

Referring to FIG. 5 through 7, a second embodiment is illustrated wherein like elements to the first embodiment have like identifying numerals except with the addition of a prime symbol suffix. A fabric assembly 20' may include a knitted fabric 24' having a plurality of fusible yarns, or threads, 38'. One of the plurality of fusible yarns 38 may be loosely knitted forming a plurality of loops 32' projecting outward from a surface 46' of the fabric 24', see FIG. 5. During manufacturing, the knitted fabric may be fused (e.g., steamed), thereby strengthening the fabric 24' into a coherent sheet and stiffening the loops 32, see FIG. 6. With the loops 32' being less compliant than when initially knitted, they may be cut. When cut, each loop 32' is transformed into two hooks 50, 52 capable of hooking, for example, to loops projecting outward from a component, see FIG. 7.

Figure 8:
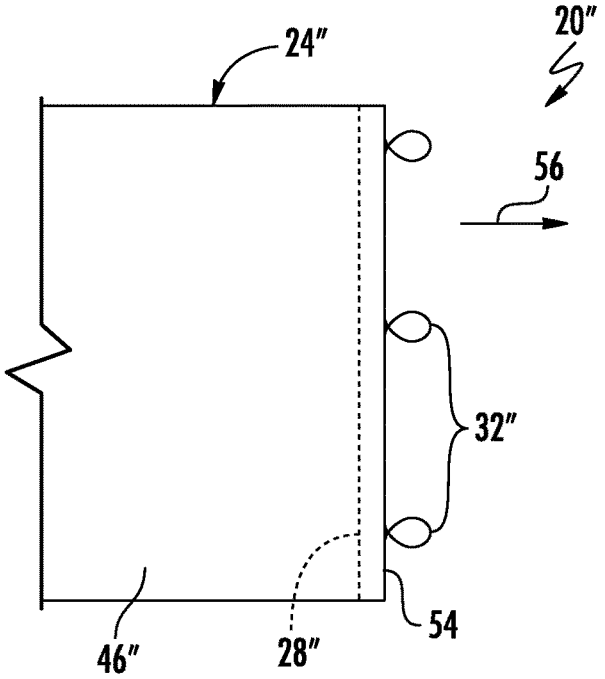
FIG. 8 is a plan view of a third embodiment of the fabric assembly in a relaxed state.
Figure 9:
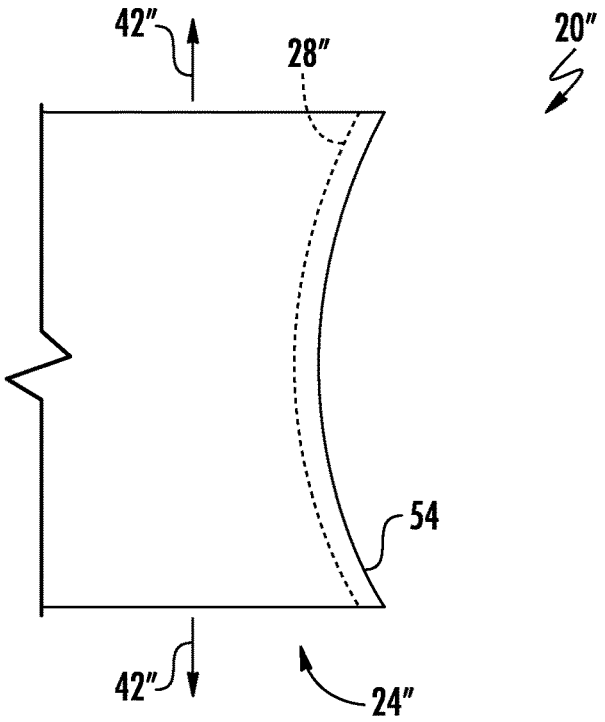
FIG. 9 is a plan view of the fabric assembly of FIG. 8 in a stretched state.

Referring to FIGS. 8 and 9, a third embodiment is illustrated wherein like elements to the first and/or second embodiments have like identifying numerals except with the addition of a double prime symbol suffix. A fabric assembly 20" includes a knitted fabric 24" and a filament 28" including a plurality of loops 32". The knitted fabric 24" may include a surface 46" that may be substantially planar and an edge 54. When the knitted fabric 24" is in a relaxed state (see FIG. 8), the loops 32" may project outward from the edge 54. In one embodiment, the loops 32" may be coplanar to the fabric 24" or fabric surface 46".

When the knitted fabric 24" is stretched along the direction of the exerted force 42" (see FIG. 9), the edge 54 is effectively lengthened causing the loops 32" to generally retract into the knitted fabric 24". In this embodiment, the edge 54 of the fabric 24" may be attached to a component with hooks (i.e., not shown), and the fabric 24" and component may be cinched and held together by maintaining the fabric 24" in the stretched state.

Advantages and benefits of the present disclosure include the ability to easily and simply cinch a fabric to another component. Other advantages include the ability to integrate an electrical connection as part of the cinching operation.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof.

What is claimed is:

1. A fabric assembly comprising:

a knitted fabric including a stretched state and a relaxed state, wherein the knitted fabric is generally lengthened along a direction of an exerted force when in the stretched state;

an elongated filament disposed in the knitted fabric and disposed substantially normal to the direction of the exerted force, the elongated filament including a plurality of loops longitudinally spaced apart from one-another, wherein each loop of the plurality of loops projects outward from the knitted fabric when in the stretched state and substantially retracts into the knitted fabric when in the relaxed state.

2. The fabric assembly set forth in claim 1, further comprising:

a component including a plurality of hooks projecting outward from the component for engaging the plurality of loops when in the stretched state and thus cinching the component to the knitted fabric when in the relaxed state.

3. The fabric assembly set forth in claim 2, wherein the elongated filament and the plurality of hooks are electrically conductive.

4. The fabric assembly set forth in claim 2, wherein the cinching occurs along a direction that is substantially normal to the elongated filament and the direction of the exerted force.

5. The fabric assembly set forth in claim 1, wherein the knitted fabric is more compliant than the elongated filament.

6. The fabric assembly set forth in claim 5, wherein the elongated filament is one of a mono-filament and a braided cable.

7. The fabric assembly set forth in claim 1, wherein the knitted fabric is a double knitted fabric.

8. The fabric assembly set forth in claim 1, wherein at least one loop of the plurality of loops are looped about a knit yarn of the knitted fabric to fix a location of the at least one loop.

9. The fabric assembly set forth in claim 1, further comprising:

a plurality of buttons, wherein each button of the plurality of buttons is attached to a respective loop of the plurality of loops.

10. The fabric assembly set forth in claim 1, wherein the knitted fabric is fusible.

11. The fabric assembly set forth in claim 10, wherein the elongated filament is fusible.

12. A fabric assembly adapted to engage a component, the fabric assembly comprising:

a knitted fabric including a stretched state along a first direction and a relaxed state;

a filament inserted into the knitted fabric, and including a plurality of attachment elements, wherein each attachment element of the plurality of attachment elements projects outward from the knitted fabric when in one of the stretched state and the relaxed state, and retracts into the knitted fabric when in the other of the stretched state and the relaxed state; and a plurality of mating elements attached to and projecting outward from the component, wherein each mating element of the plurality of mating elements is constructed and arranged to engage a respective one of the plurality of attachment elements when projecting outward from the knitted fabric, and thereby cinch the knitted fabric to the component when the plurality of attachment elements retract into the knitted fabric.

13. The fabric assembly set forth in claim 12, wherein the knitted fabric includes a surface, the plurality of attachment elements project outward from the surface, the filament extends along a second direction that is substantially normal to the first direction, and the plurality of attachment elements retract when the knitted fabric moves from the stretched state to the relaxed state.

14. The fabric assembly set forth in claim 12, wherein the knitted fabric includes an edge, the filament extends along the edge, the plurality of attachment elements project outward from the edge when in the relaxed state and are retracted into the knitted fabric when in the stretched state.

15. The fabric assembly set forth in claim 14, wherein the plurality of loops are generally coplanar to the knitted fabric.

16. The fabric assembly set forth in claim 12, wherein the plurality of attachment elements include hooks.

17. The fabric assembly set forth in claim 12, wherein the plurality of attachment elements include loops, and the plurality of mating elements include hooks.

18. The fabric assembly set forth in claim 12, wherein the plurality of attachment elements include posts.

19. The fabric assembly set forth in claim 12, wherein the plurality of attachment elements include buttons.

20. The fabric assembly set forth in claim 12, wherein the plurality of attachment elements include clips.

* * * * *